US007389620B1

(12) United States Patent
McManus

(10) Patent No.: US 7,389,620 B1
(45) Date of Patent: Jun. 24, 2008

(54) COMPOSITE PAN FOR COMPOSITE BEAM-JOIST CONSTRUCTION

(76) Inventor: Ira J. McManus, 39 Lincoln Ave., Florham Park, NJ (US) 07931

( * ) Notice: Subject to any disclaimer, the term of this patent is extended or adjusted under 35 U.S.C. 154(b) by 342 days.

(21) Appl. No.: 10/921,702

(22) Filed: Aug. 19, 2004

(51) Int. Cl.
*E04B 1/18* (2006.01)

(52) U.S. Cl. ..... 52/414; 52/334; 52/326; 52/335

(58) Field of Classification Search ..... 52/334, 52/326, 335, 414
See application file for complete search history.

(56) References Cited

U.S. PATENT DOCUMENTS 3,307,304 A * 3/1967 Klausner ..... 52/99
3,527,007 A * 9/1970 McManus ..... 52/327
3,683,580 A * 8/1972 McManus ..... 52/334
4,056,908 A * 11/1977 McManus ..... 52/334
4,259,822 A * 4/1981 McManus ..... 52/334
4,295,310 A * 10/1981 McManus ..... 52/334
4,333,280 A * 6/1982 Morton ..... 52/167.1
5,941,035 A * 8/1999 Purse ..... 52/263
6,761,005 B1 * 7/2004 Daudet et al. ..... 52/272

* cited by examiner

*Primary Examiner*—Jeanette Chapman
*Assistant Examiner*—Dan Kenny
(74) *Attorney, Agent, or Firm*—W. Patrick Quast

(57) ABSTRACT

Composite pan end connections for composite beam-joist construction are disclosed. Two versions of the composite pan can be fabricated on a standard break machine. A third version disclosed makes use of a standard steel stud. All three versions provide an economical, easily installed horizontal platform secured to the top chord seat angles of either conventional or composite open-web joists. In addition to economy in fabrication, and ease of use, the resulting rectangular shape of the concrete slab over the beam is structurally more efficient than heretofore obtainable.

12 Claims, 12 Drawing Sheets

COMPOSITE PAN FOR COMPOSITE BEAM-JOIST CONSTRUCTION

This invention relates to concrete and steel floor and roof construction, and in particular to composite pan structures facilitating composite beam-joist construction and methods.

BACKGROUND

Currently most commercial buildings and some apartment complexes are constructed making use of steel supported concrete floors and roofs. Traditional methods employ steel joists, usually being placed parallel to one another, being secured at each of their ends to structural building members such as steel or concrete beams or girders. Each joist end rests on these members, the beams generally running perpendicular to the placement of the joists. The steel joist themselves are usually of the open-web design, each one consisting of a zigzag shaped rod connecting a joist top chord and a bottom chord which run a spaced distance apart and parallel to one another. Both the top and bottom chords are comprised of opposed angle iron members affixed together by means of the apices of the connecting rod. The bearing end of each joist is further comprised of a pair of flange connected seat angles extending laterally from each opposed angle iron so as to form a pair of U shaped channels at each joist bearing end. Corrugated metal decking is then placed on top of the joists, and finally concrete is poured over the corrugated decking and the joist ends and top surface of the beams or girders.

An important step in concrete steel structures is to insure a fully composite structure is created between the concrete, joist ends, and top surface of the beams. Benefits of composite structure include stronger, stiffer concrete slabs; lower building costs due to less weight of the beams and joists; decreased sound and vibrations transmission; floors more resistant to bounce and wind deflection. To accomplish this shear studs are affixed adjacent the joist ends on the top surface of the beams and metal pans are secured between the joist ends, the edge of the corrugated deck, and the top surface of the beam. Concrete is now poured over the combination of the composite pan, shear studs, joist ends, beam top surface, and the top surface of the corrugated decking. The composite pan forms the end connection for this composite beam-joist system, and causes the concrete to haunch down onto the beam surface, making it composite with the concrete slab.

The present invention discloses novel and useful composite pan structures, which will be fully described and illustrated below.

It is therefore a primary object of the present invention to provide a superior composite pan, composite beam-joist construction.

It is a further object of the invention to provide a rectangular and therefore structurally more efficient shape of the concrete slab on the beam.

An additional object of the invention is to provide a simplified and economical method of manufacture for a composite pan.

Yet another object of the invention is to provide a composite pan for both conventional open web joists as well as composite open web joists.

Still another object of the invention is to provide a composite pan for operator positioning either above or below the joist top chords.

An additional object of the invention is to provide a composite pan that can be formed on a standard break machine.

SUMMARY

These and other objects are obtained with the composite pan and method of the present invention.

In a previous invention (U.S. Pat. No. 3,683,580—issued Aug. 15, 1973) I disclosed a unitary or single metal composite pan 50 (FIGS. 1 and 2). The pan is placed between bearing ends of steel joists, being supported by a continuous angle pan support rod positioned beneath a bend in the pan. The continuous angle rod itself is secured on top of, and runs perpendicular to, the top surface of the joist top chords. The pan then slopes downward to contact the top surface of the supporting beam. With the sides of the pan secured to opposed bearing ends of a pair of joists, and with the front end of the pan contacting the top surface of the support beam and the rear end of the pan contacting an edge of the corrugated decking, when the concrete is now poured over the decking and support beam, the pan insures the beam is composite with the concrete.

Again in a previous invention (U.S. Pat. No. 4,056,908—issued Nov. 8, 1977) I disclosed a similar composite pan 25 (FIG. 5) cooperating with a composite open-web joist. For the purpose of the discussion, the term conventional open-web joist refers to the previously described steel joists in which the apices of the zigzag connecting rod are positioned between the top chord angle irons. The term composite open-web joist refers to the steel joists of U.S. Pat. No. 4,056,908, in which the apices of the zigzag connecting rod protrude through the upper chord members of the joist. Matching cut-out slots to the joist protruding apices in the corrugated decking further enhance the composite structure. In this case the composite pan 25 again is supported by a continuous angle pan support rod running perpendicular to the top joist, with the rear end of the composite pan connecting with an edge of the corrugated decking, and with the composite pan then sloping downward to make contact with the top surface of the supporting beam.

It occurred that a rectangular shape of the concrete over the supporting beam would be structurally more efficient than the triangular shape effected by the above described composite pans. To this end a series of composite pans are devised to eliminate this sloped configuration of the concrete over the beams.

For example, a first composite pan can be formed from a rectangular section of sheet metal having a 90° downwardly extending flange at one end and an outwardly extending 90° seat angle from the flange to form a U shaped channel at this end of the metal sheet. This first composite pan requires a modification to the bearing ends of the joists during fabrication to hold back the top chord angles a spaced distance from the joist end. This permits an operator standing on the steel beam to simply drop this composite pan onto the joist bearing end and then push it outward from the beam until it is stopped by the new position of the top chord angles. In a modified version of this first composite pan, the structure is substantially identical except the flange forming the U shaped channel extends in the opposite direction, i.e. parallel to and away from the top surface of the pan. Again, an operator simply drops this modified version first composite pan onto the joist bearing end and then pushes it outward from the beam until it is stopped by the new position of the top chord angles.

In a second version of the composite pan an "off the shelf" cold formed steel stud can be cut to size and employed as a composite pan. The cold formed steel stud already has preformed U shaped channels at its left and right sides. The cut to size steel stud is now simply placed by an operator between the horizontal outstanding legs of the joist bearing end top seat angles, and field welded to the seat angles so as to be secured in place.

In a third version of the composite pan a rectangularly shaped section of sheet metal has a flange on a first side extending downwardly at a 90° angle from the top surface, a second flange extending outwardly from the base of this first flange at a 90° angle and having a downwardly extending tab positioned midway along the length of this second flange, and a third flange positioned on the second side of the rectangularly shaped metal sheet extending downwardly at a slightly greater than 90° angle from the top surface of the metal sheet. An operator simply positions this third version composite pan between the horizontal outstanding legs at the bearing ends of the joist top chord angles, with the tab stop automatically positioning the pan a set dimension over the top surface of the beam flange. The operator can position the second and third version composite pans while being either above or below the joists.

It can be seen that in all three versions of the composite pan of the invention a horizontal surface is maintained for the purposes of concrete slab formation between the joist bearing ends, the corrugated decking, and the top surface of the beam. The composite pans can be fabricated in a variety of materials including wood and plastic according to construction requirements, with sheet steel being the material of choice.

DETAILED DESCRIPTION

Figure 1:
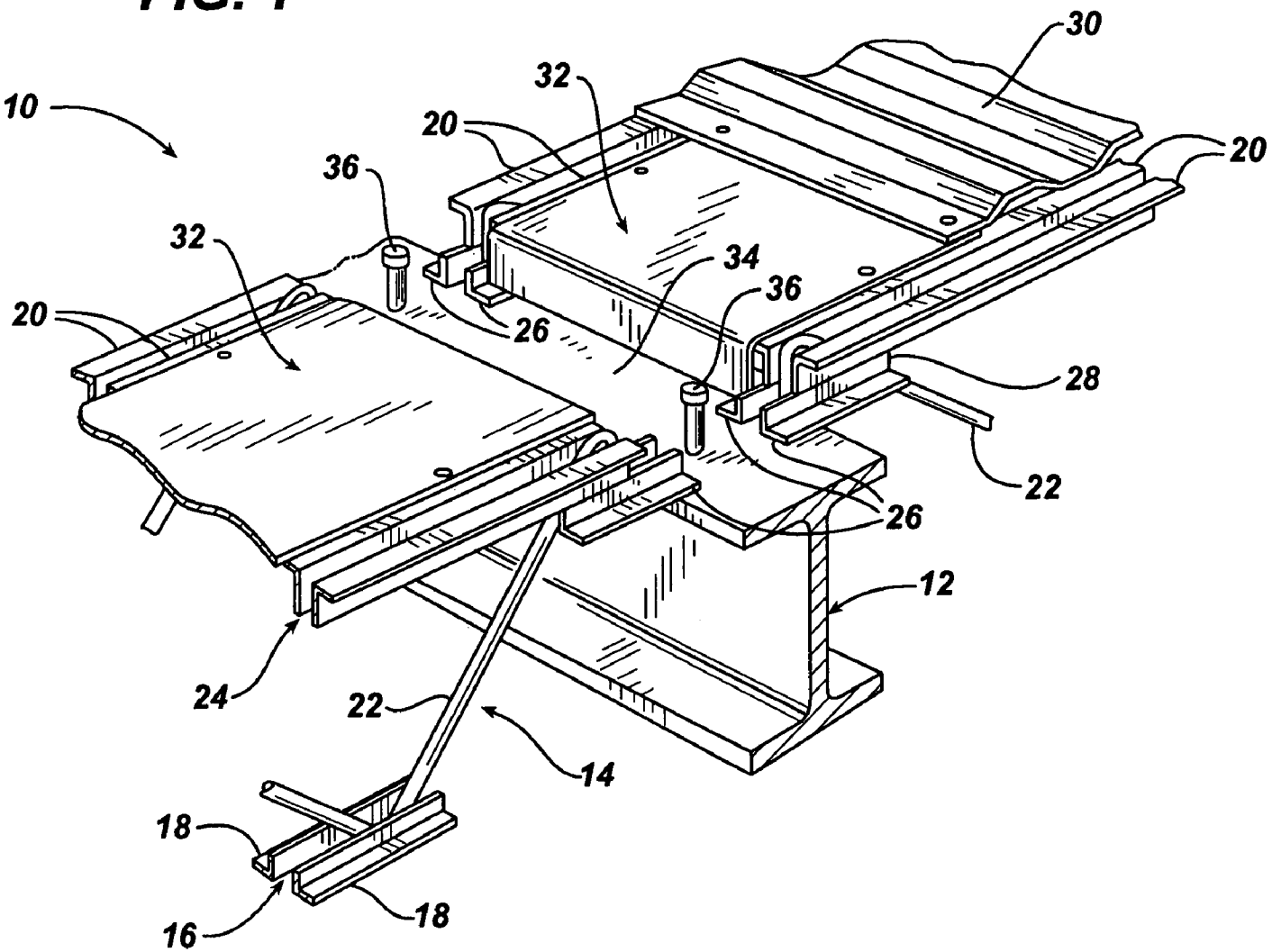
FIG. 1 is a partially cut away, perspective view showing one version of the composite pan of the invention in place on modified joist bearing ends secured to a beam.
Figure 4:
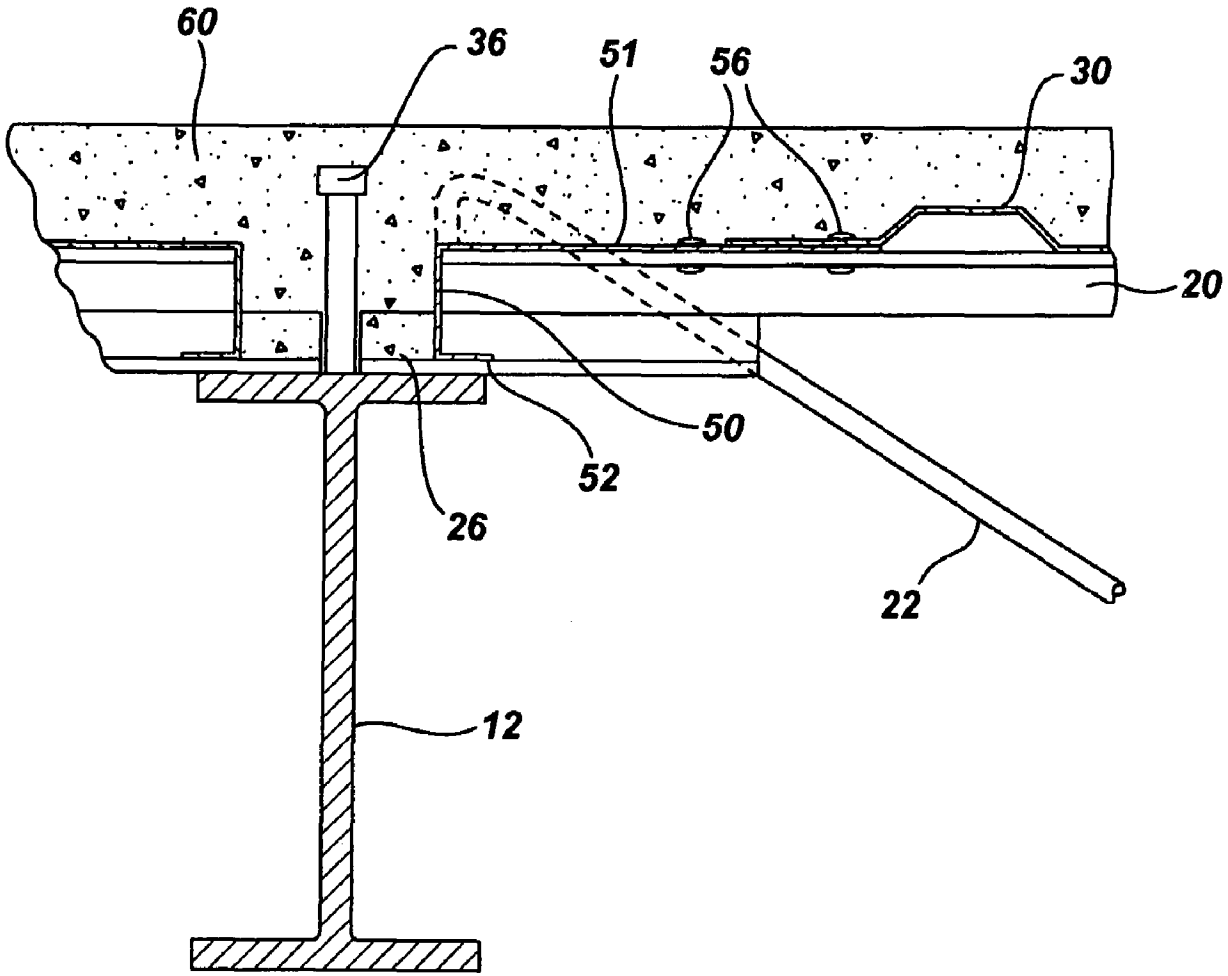
FIG. 4 is a cross sectional view of the composite pan of FIG. 3 shown in place encased in concrete on a beam.

Turning now to the drawings wherein similar structures having the same function are denoted with the same numerals, in FIG. 1 a composite beam-joist system 10 is depicted. A composite open web joist 14 is shown with its web rod 22 connecting a bottom chord 16, and a top chord 24. The bottom chord 16 is comprised of a pair of angle irons 18 with web steel rod 22 sandwiched in between, with the top chord 24 similarly being comprised of a pair of angle irons 20. The bearing end of the joist 14 is shown contacting the top surface 34 of a steel beam 12, and comprises a pair of bottom left and right seat angles 26 interconnected to left and right side flanges 28 of respective ones of angle irons 20. As best seen in FIGS. 4 and 4 A the rod 22 apex (shown in phantom) can protrude above the top chord top bearing end seat angles 20 to form the composite open-web joist or be essentially flush with the top surfaces of angle irons 20 (See FIG. 1). A first version 32 of the composite pan of the invention is shown providing a horizontal surface between the bearing ends of the joists 14, the corrugated decking 30, and the top surface of the beams 34. Shear studs 36 are shown in place adjacent the ends of the top chord bottom seat angles 26. Concrete now poured over this structure creates a beam composite with the concrete, with the concrete now structurally more efficient than heretofore obtainable.

Figure 2:
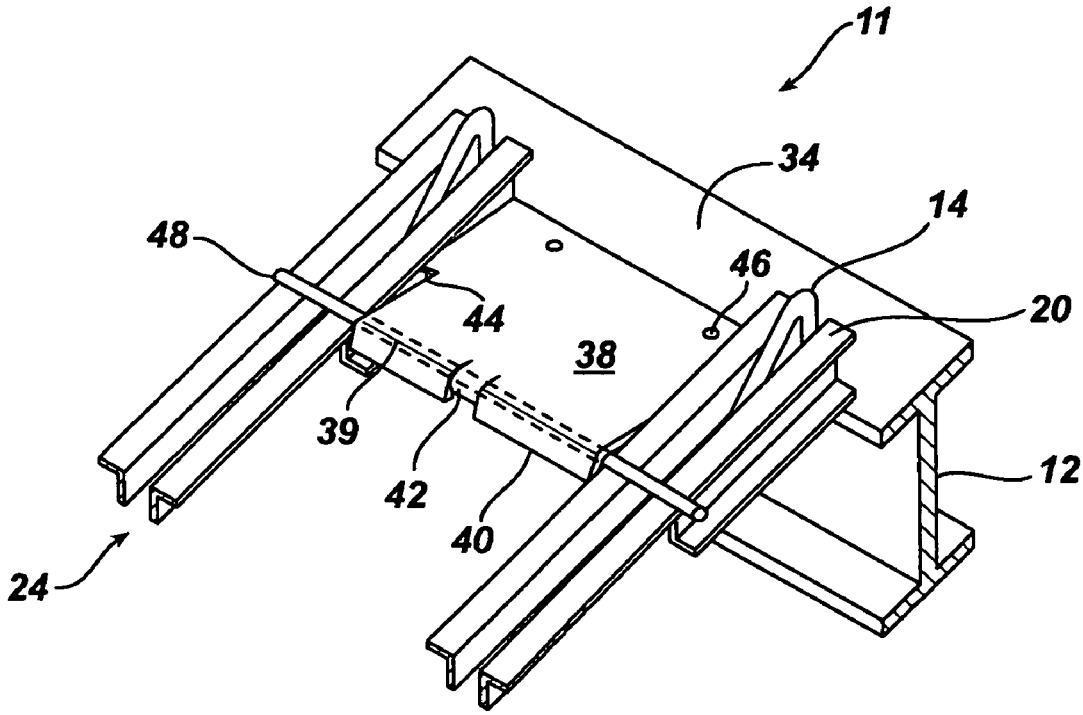
FIG. 2 PRIOR ART
FIG. 2 is a top plan schematic view of a prior art composite pan.

In contrast to FIG. 1, in FIG. 2 a composite beam-joist system 11 is depicted employing a prior art sloped composite pan 38. This prior art composite pan 38 is fabricated from a generally rectangularly shaped sheet of steel with opposed left and right side notched panels 44 enabling the pan to slip under the top left and right top chord seat angles 20. A rear section of this pan has a bend 39 across its width to accommodate a support rod 48 running beneath the pan at this bend line. The support rod 48 is positioned in contact with the top surface of the left and right top chord seat angles 20. A sloped rear portion 40 of this pan has a centrally positioned notched segment 42 securing this rear portion of the pan to the support rod 48. The front portion of this prior art composite pan 38 then slopes downward, contacting and being affixed for example, via weld 46 to the beam top surface 34. Concrete now poured over this structure will yield a beam composite with the concrete, but the resulting concrete slab over the beam will not be as structurally efficient as is achieved with, for example, the above described first version composite pan 32 and the others that follow.

FIGS. 3, 4, 5A, and 5B provide detailed illustrations of a first version of the composite pan 32. The composite pan 32 is generally rectangular in shape, being fabricated in sheet metal with a gauge to suit joist spacing and typically with a minimum gauge of 26. An approximate 90° bend forms a panel 50 perpendicular to the top surface of the pan across the width at one end of the pan, and a second approximate 90° bend on this panel 50 to form a flange 52 parallel to the pan top surface 51. The height of panel 50 can be approximately 2¼", while the flange 52 extends approximately 1". The width of the overall first version composite pan is, of course, dictated by the spacing between joists which can run up to 48". Top surface 51 extends back along the angle irons 20 a sufficient length as desired.

Figure 5A:
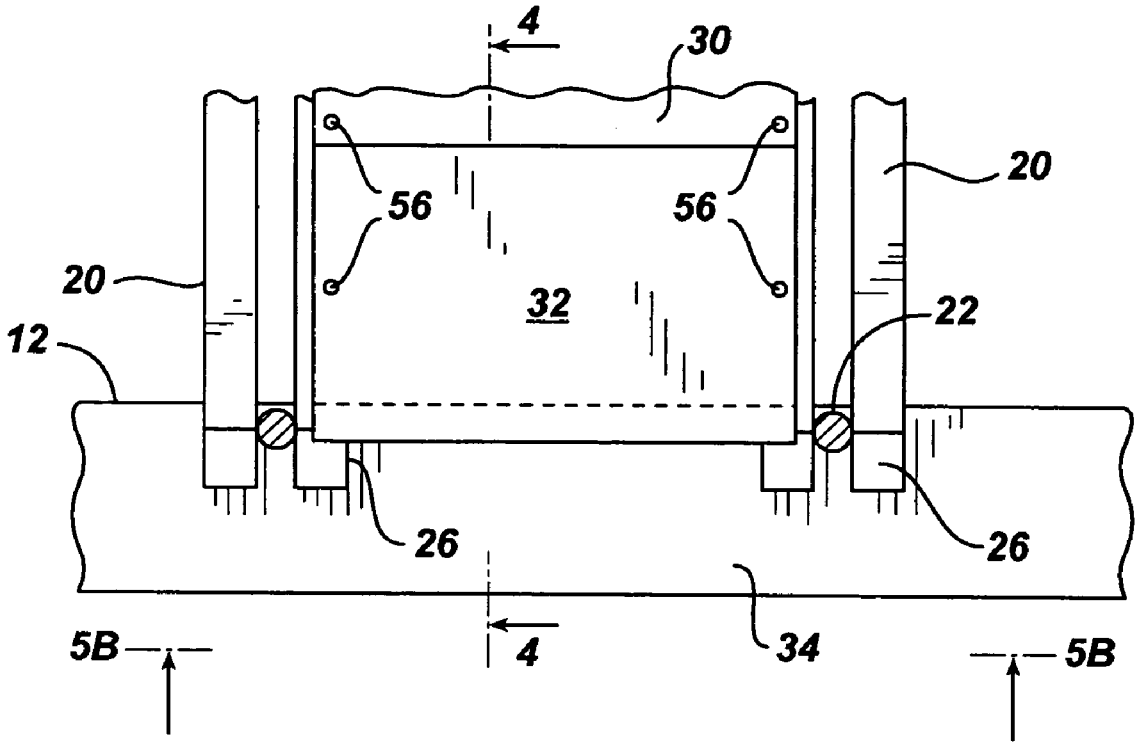
FIG. 5A is a top plan schematic view of the composite pan of FIGS. 3 and 4 further illustrating the modified joist bearing ends required by the composite pan structure.
Figure 5B:
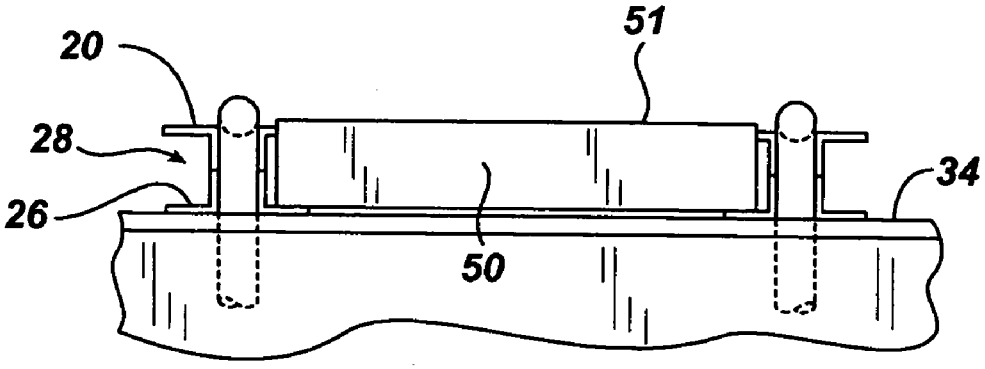
FIG. 5B is a side, elevational schematic view of the composite pan of FIGS. 3, 4, and 5A, taken along the line 5B-5B of FIG. 5A.

As best seen in FIGS. 5A and 5B, the first version composite pan 32 can be simply dropped down onto the joist bearing end by an operator (not shown) and pushed forward until the U shape channel 53 at the end of the pan 32 is stopped by the top chord angles 20. As seen in FIG. 5A, in the case of composite pan 32 it is necessary to modify the joist bearing ends by cutting back the top chord top seat angles 20 a spaced distance to accommodate the insertion of the composite pan 32 by providing room for the location of shear studs 36.

FIG. 4 illustrates the pan 32 in a finished composite beam-joist system 10. The surface 51 of composite pan 32 is shown affixed to the top chord top seat angles 20, and to the end of a corrugated deck 30 by means of, for example, deck screws 56 or welds. A concrete slab 60 is shown encasing the joist bearing end, the first version composite pan 32, shear studs 36, and the top surface of the beam 34, forming a superior composite beam-joist connection.

Figure 3:
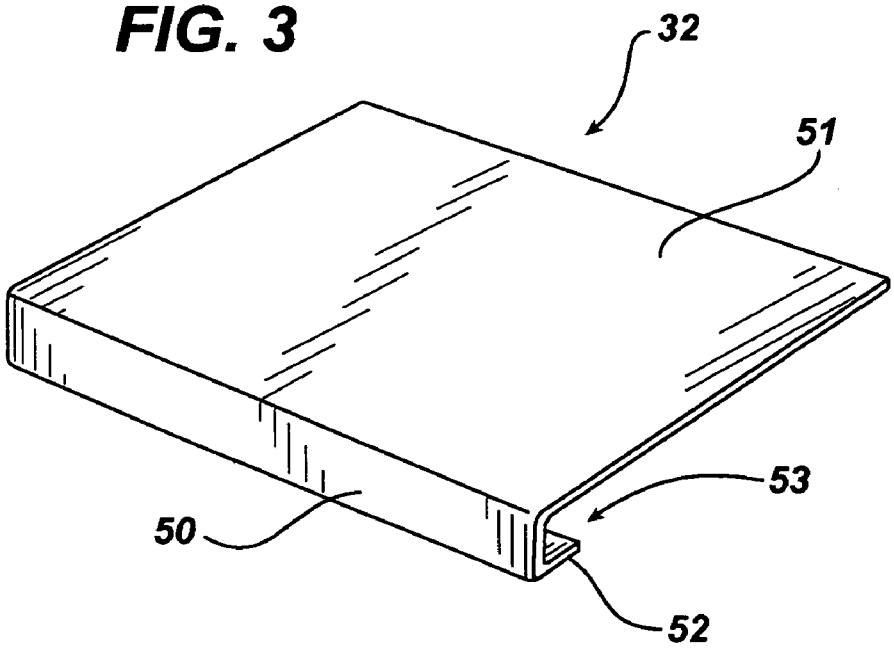
FIG. 3 is a side, perspective view of one version of the composite pan of the invention.
Figure 3A:
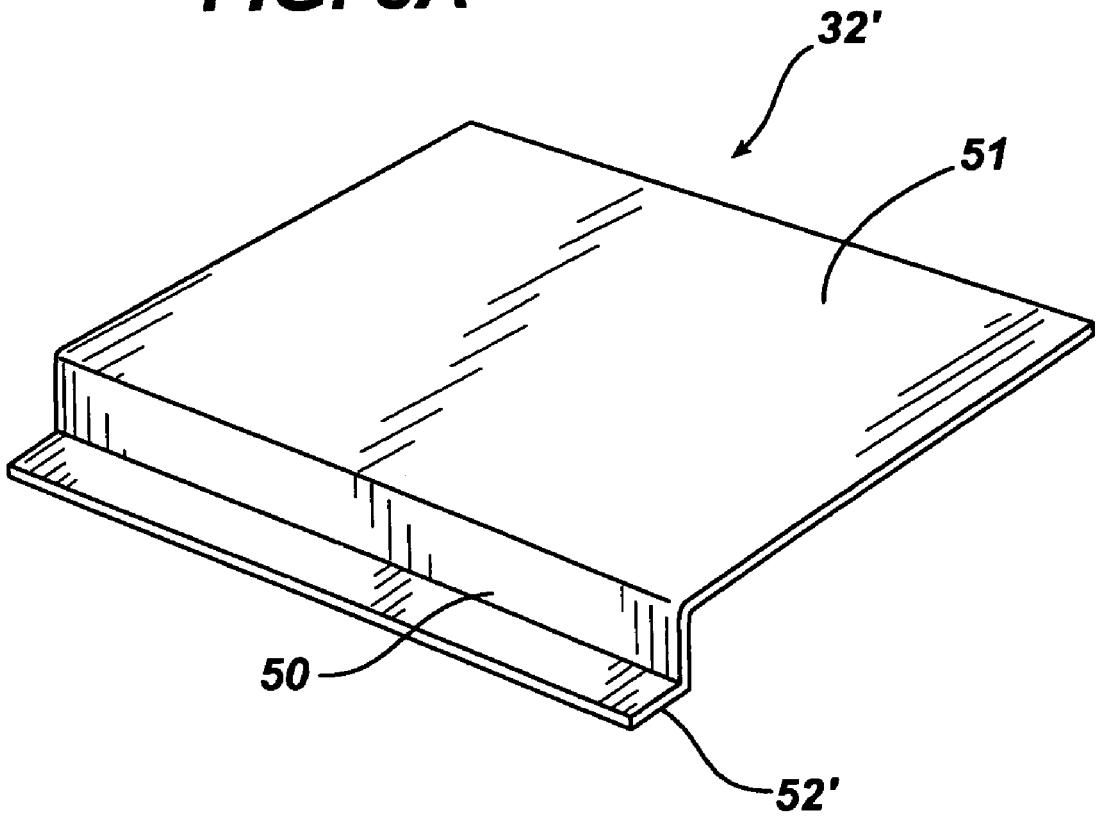
FIG. 3A is a side, perspective view of one version of the composite pan of the invention showing a modified version of the composite pan depicted in FIG. 3.
Figure 4A:
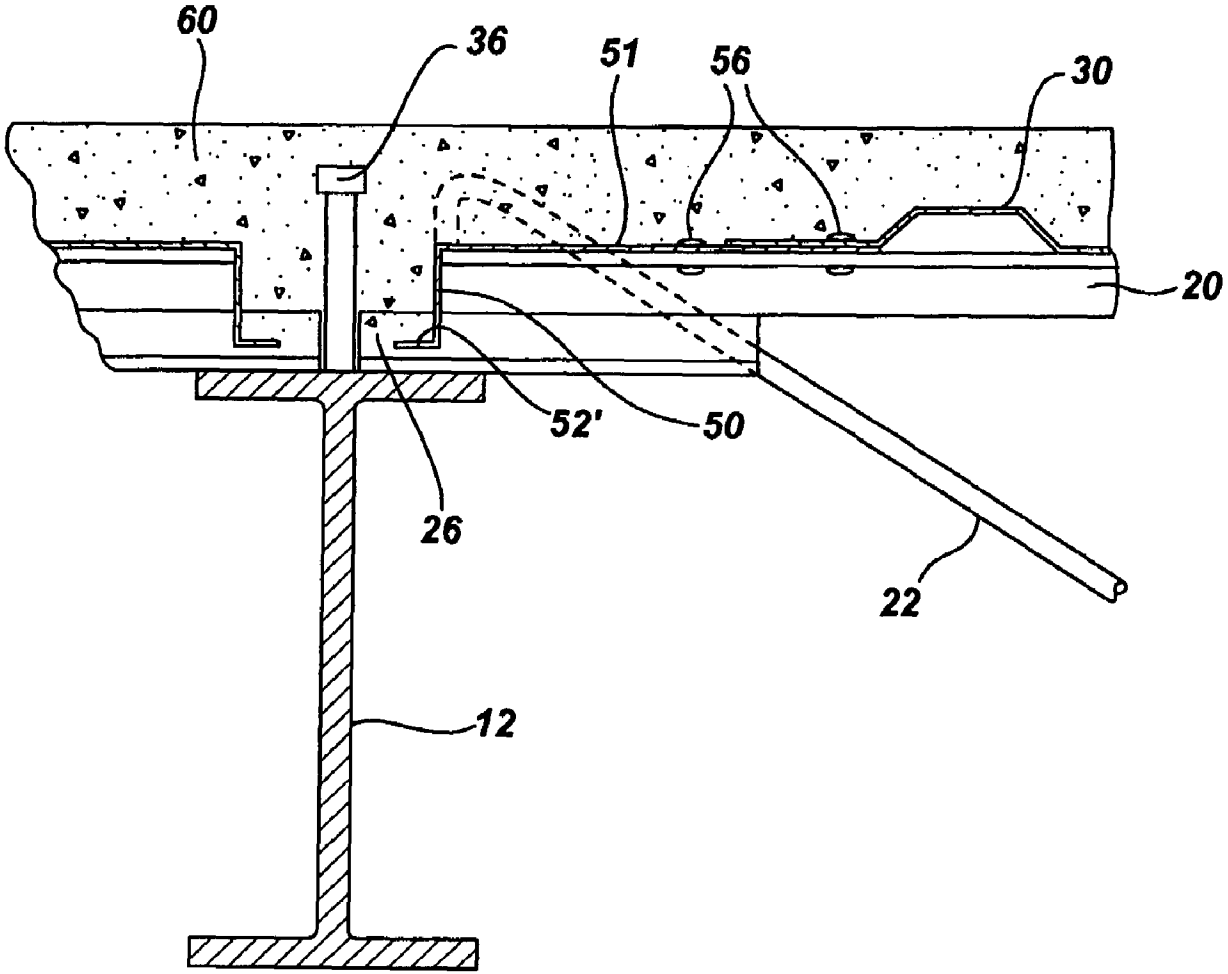
FIG. 4A is a cross sectional view of the composite pan of FIG. 3A shown in place encased in concrete on a beam.

FIGS. 3A and 4A illustrate a modified version 32' of the above described first version of the composite pan 32. The structure of the two composite pans (32, 32') is substantially identical except that flange 52 of the first composite pan 32 which forms a U shaped channel 53 beneath the top surface 51 now extends in the opposite direction parallel to and away from the top 51, thereby forming a shelf-like structure 52'.

FIG. 4A illustrates this modified version 32' of first version composite pan 32 in a finished composite beam-joist system as similarly illustrated in FIG. 4 for the first version composite pan. Again, as in the case of the first version composite pan, modified version 32' can be simply dropped down onto the joist bearing end by an operator (not shown) and pushed forward until the downwardly extending panel 50 at the end of the pan 32' is stopped by the top chord angles 20. Similarly, as illustrated in FIG. 5A for first version composite pan 32, it is necessary to modify the joist bearing ends by cutting back the top chord top seat angles 20 a spaced distance to accommodate the insertion of the modified version 32' of the first version composite pan 32 by providing room for the location of shear studs 36.

Figure 6:
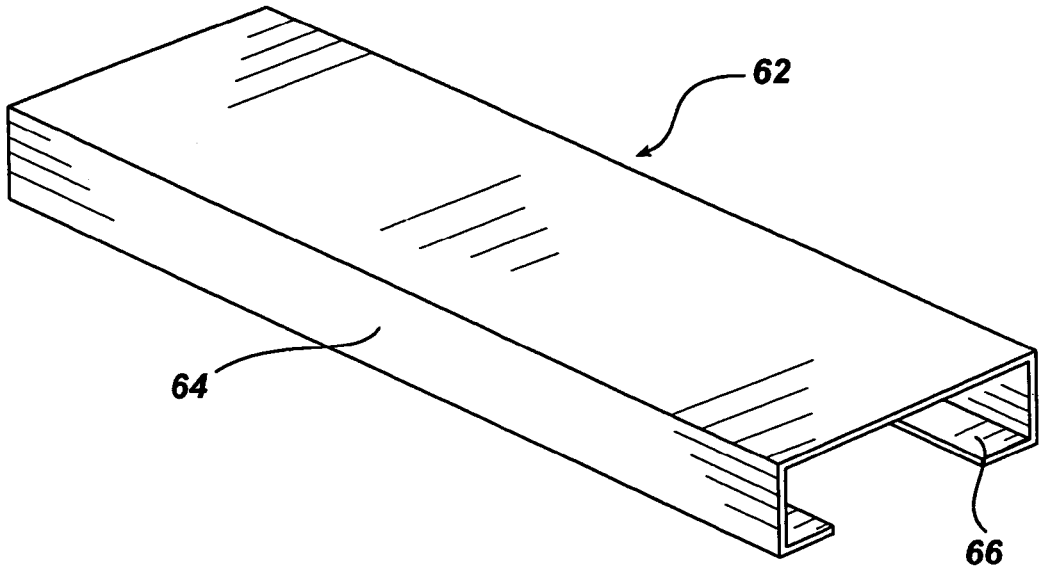
FIG. 6 is a perspective view of one version of the composite pan of the invention.
Figure 7:
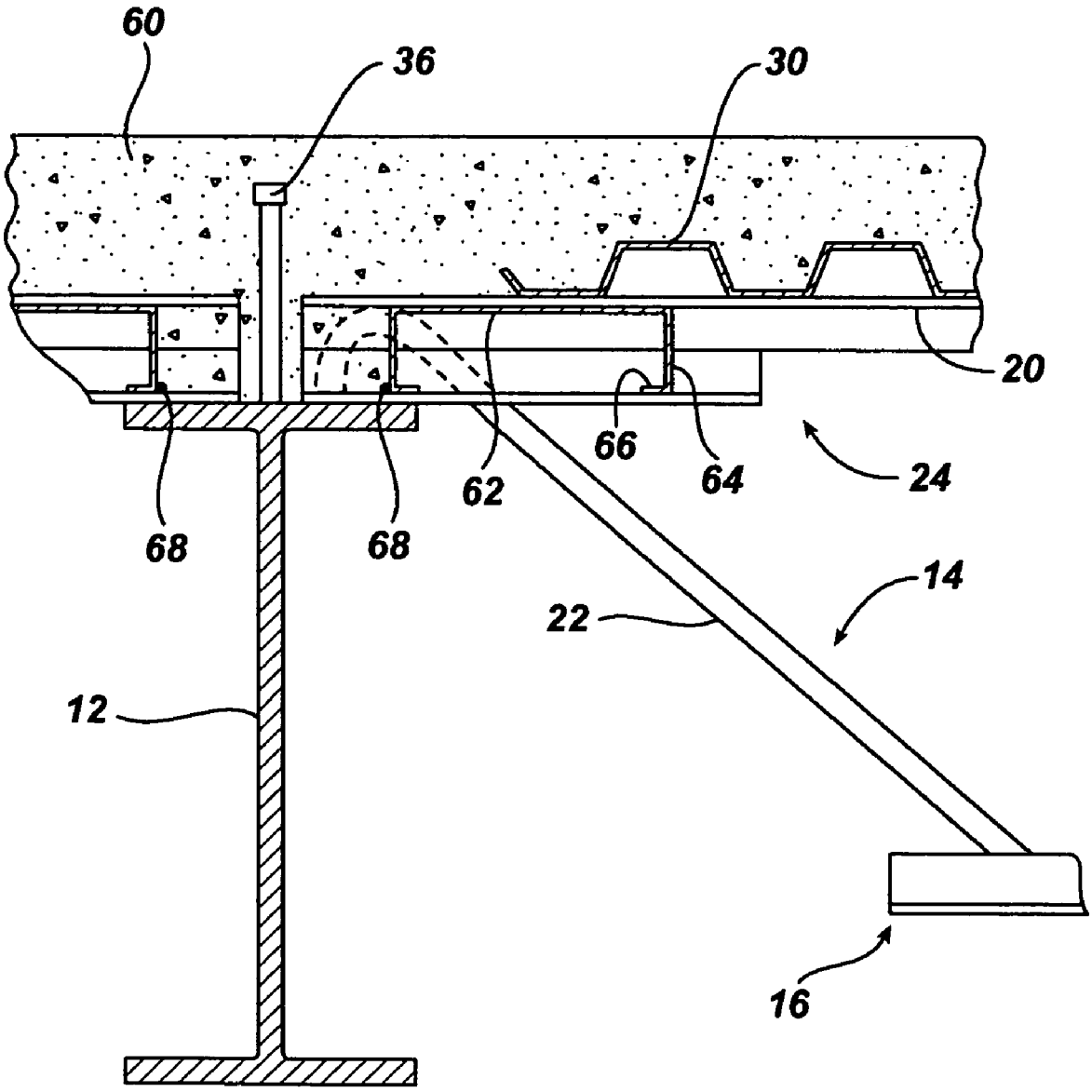
FIG. 7 is a cross sectional view showing the composite pan of FIG. 6 in place encased in concrete on a beam.
Figure 8:
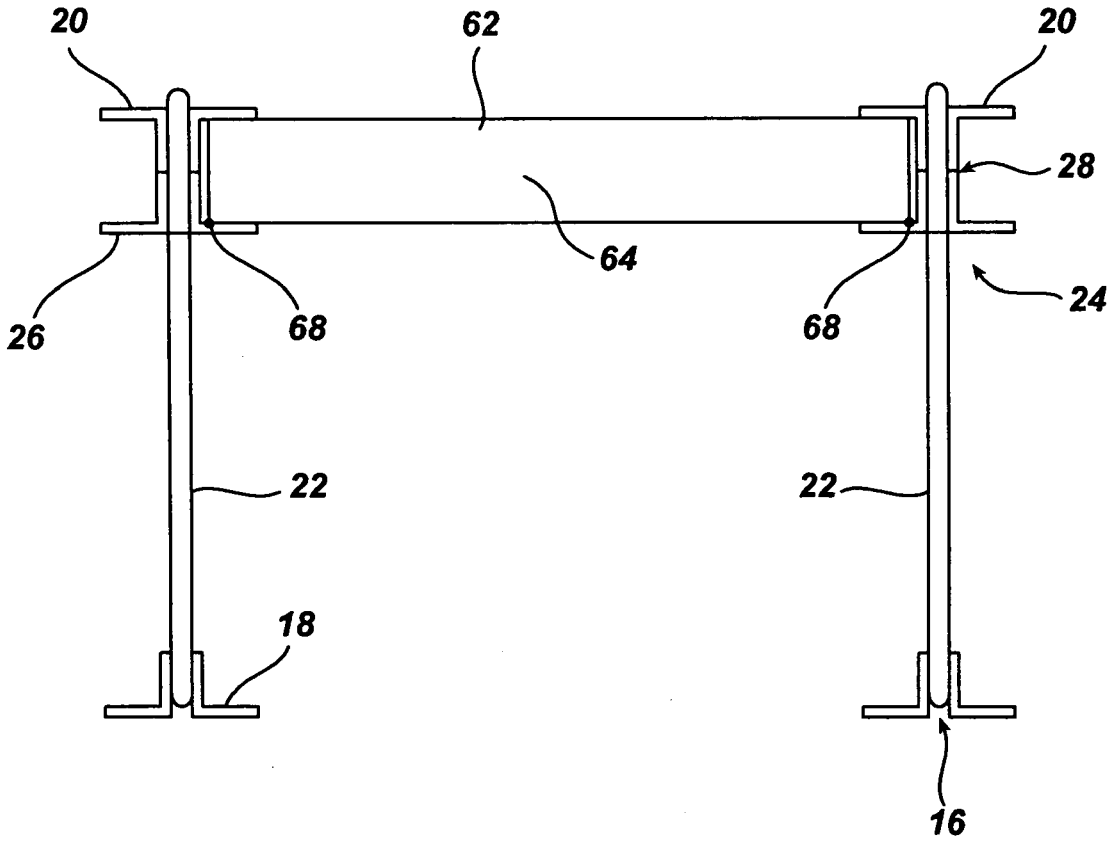
FIG. 8 is a front, elevational schematic view of the composite pan of FIGS. 6 and 7 shown secured at both left and right sides within opposed joist bearing end seat angles.

FIGS. 6, 7, and 8 depict a second version composite pan 62 of the invention. As seen in FIG. 6, a standard, off-the-shelf steel stud used in the construction of building walls, etc., serves to form the composite pan 62. The steel stud is cut to whatever length the joist bearing ends dictate. The stud typically is 6" wide, with approximately 2" deep left and right sides 64 bent downwardly at right angles to the stud top surface, and with flanges 66, approximately ½" wide extending inwardly from and perpendicular to the ends of the stud sides 64.

FIGS. 7 and 8 illustrate the placement of this second version composite pan 62 in a composite beam-joist system. In this case the composite pan is inserted between the top 20 and bottom 26 seat angles of the top chord 24 by an operator (not shown) positioned either above or below the joist bearing ends. This second version composite pan is then affixed to the opposed seat angles, as, for example, by field welds 68 at the junction of the sides of the pan 64 and flanges 66, and top surfaces of opposed bottom seat angles 26 in order to restrain axial movement in the direction of the joist members 14. FIG. 7 illustrates this second version composite pan 62 in a complete composite beam-joist system. In this case the pan 62 is shown interconnecting open web joists 14 of the conventional design. Again, this economically fabricated and simply installed composite pan 62 cooperates with the joist bearing ends, beam top surface, and shear studs in providing a superior configured concrete slab 60 in this composite beam-joist system.

Figure 9:
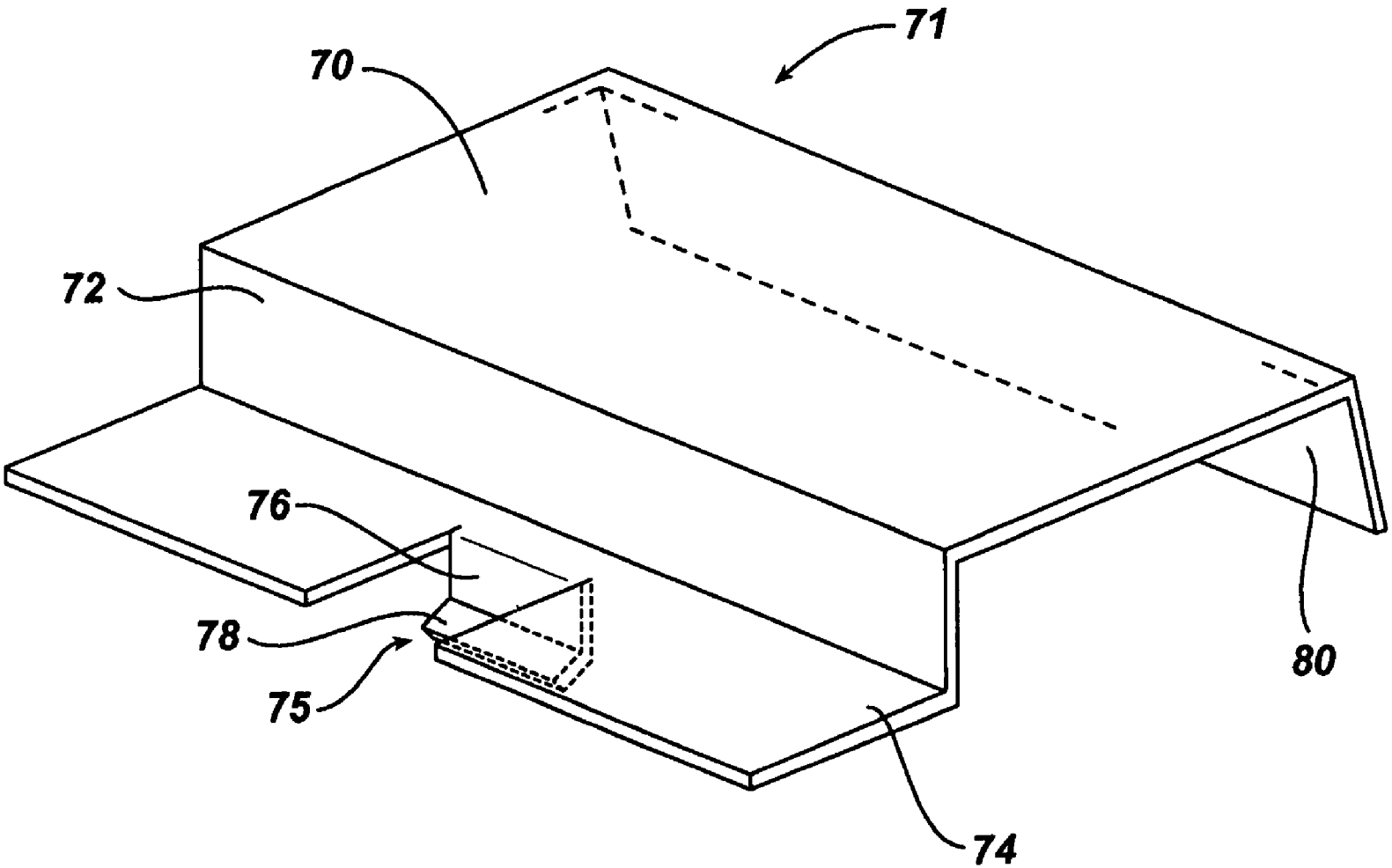
FIG. 9 is a perspective view of one version of the composite pan of the invention.
Figure 10:
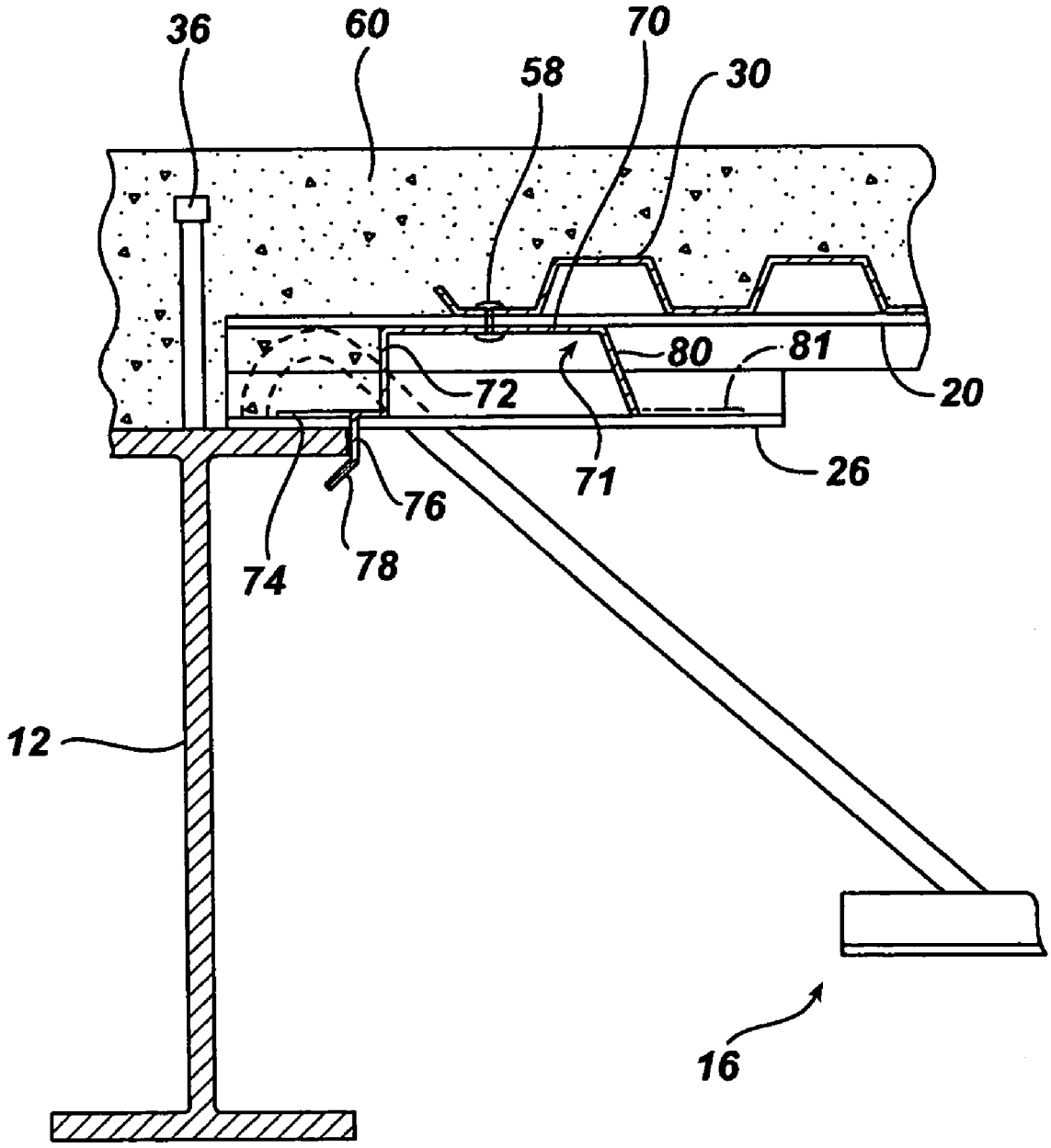
FIG. 10 is a cross sectional view showing the composite pan of FIG. 9 in place and encased in concrete on a beam.
Figure 11:
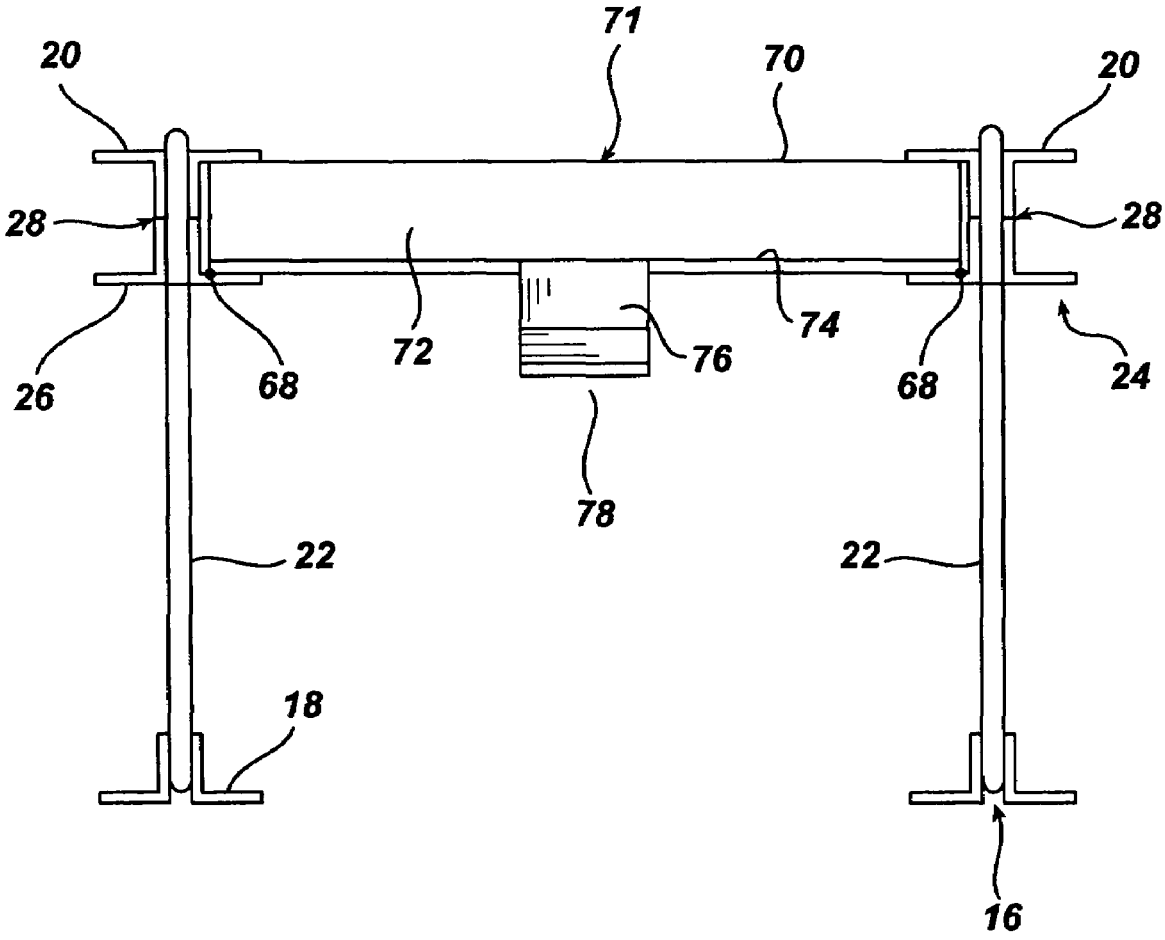
FIG. 11 is a front, elevational schematic view of the composite pan of FIGS. 9 and 10 shown secured at both left and right sides within opposed joist bearing end seat angles, with a front, center positioned tab in place for contacting a beam top flange.

In FIGS. 9, 10, and 11 a third version composite pan 71 of the invention, and its method of use, is illustrated. Again a generally rectangular shaped metal sheet has a top surface 70 measuring approximately 5" wide with the length once again determined by the spacing between joist members. A left side 72 measures approximately 2⅛" deep and extends substantially at a right angle to the top surface. The base of this left side includes an outwardly extending flange 74 measuring approximately 2½" in width and being perpendicular to the left side 72. At the right side of the top surface 70 a panel 80 measuring approximately 2¼" wide extends downwardly at an approximate 100° angle to the top surface 70. An outwardly extending flange 81 at the base of panel 80 and positioned parallel to top surface 70 (shown in phantom in FIG. 10) may be added to further stabilize the composite pan 71 in position. A centrally located tab cut-out 75 on the flange 74 is formed by the tab having a downwardly right angle bent portion 76 confluent with an obtuse angled forward bent portion 78 of the tab cut-out.

FIGS. 10 and 11 illustrate the placement of this third version composite pan 71 of the invention cooperating to form a composite beam-joist system. Again, the composite pan 71 is inserted between the horizontal legs of the opposed top 20 and bottom 26 seat angles. An operator (not shown) can accomplish this while being positioned either above or below the joist bearing ends. The right side panel 80 slopes slightly away from the perpendicular of the top surface 70, and is slightly longer than left side panel 72. As composite pan 71 is inserted, it is hammered or forced toward the beam 12 so that the natural spring action wedges it in place, thereby preventing movement outward i.e., along the length of the joist members away from the beam 12, until it is secured in place with deck screws 58 through the corrugated deck 30. The tab cut-out 75 prevents uplift at the beam due to wind, and so on. The tab cut-out 75 automatically positions the composite pan 71 a set dimension over the beam top surface 34.

Thus it can be seen that the novel versions of the composite pan disclosed important improvements to composite beam-joist end connections. All three composite pan structures provide a secure, horizontal surface insuring a stronger, structurally more efficient concrete slab than heretofore obtainable. In addition, significant economies in both material and labor are effected by making use of standard steel studs or utilizing one piece sheet metal blanks formed on a standard break machine, and eliminating previously required ancillary equipment such as continuous angle pan support rods. Another important advantage is that with all three new composite pan structures the position of the corrugated decking does not dictate the width of the composite pan as was previously the case. One size fits all since these new composite pan top surfaces are wide enough to accommodate any reasonable corrugated deck edge location.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. In a composite beam-joist system, comprising:

(a) a substantially horizontally positioned beam structure support member having a top surface;

(b) at least two open-web joists, said open-web joists being positioned a spaced distance apart and being substantially parallel to one another and perpendicular to said beam, each one of said open-web joists being comprised of a zigzag shaped iron rod connecting a top chord and a bottom chord, said top and bottom chords being positioned a spaced distance apart and substantially parallel to each other, each one of said top and bottom chords being comprised of a pair of opposed angle iron members affixed together by connection to apices in said zigzag shaped rod, said pair of opposed angle iron members forming said top chord for each open-web joist having a first end;

(c) each of said open-web joists having a bearing end on at least one end, said bearing end being comprised of a pair of flange connected seat angles extending laterally from the respective first end of each one of said opposed angle iron members of said top chord so as to form a pair of U shaped channels at said bearing end, a front end of said bearing ends of each of said open-web joists being placed on a top surface of said beam;

(d) corrugated decking being positioned on a top surface of said top chords of said open-web joists said corrugated decking including a plurality of flutes extending parallel to each other and to a longitudinal axis of said horizontally positioned beam structure support member, said corrugated decking having an edge parallel to the longitudinal axis of said horizontally positioned beam structure support member; and (e) one or more shear studs being affixed to said top surface of said beam adjacent said open-web joist bearing ends; the improvement comprising an end connection means disposed between said at least two open-web joists, (f) said end connection means including a composite pan, said composite pan formed from a substantially rectangular piece of material having a width approximately equal to the spaced distance between said at least two open-web joists and having a plurality of substantially rectangularly shaped segments including a horizontal top surface segment, a horizontal flange segment and a vertical panel segment disposed between, confluent with and substantially perpendicular to each of said horizontal top surface segment and horizontal flange segment, at least said vertical panel segment having no removal of material therefrom, that is, cut-out free, said horizontal top surface segment of said composite pan being positioned on and affixed to opposed top chord seat angles of adjacent open-web joists, said horizontal top surface of said composite pan extending from at least the edge of said corrugated decking to the respective first end of each of said pair of opposed angle iron members for each said open-web joist, such that said vertical panel is positioned at said respective first end of each of said pair of opposed angle iron members for each said open-web joist, said vertical panel extending downward a predetermined distance towards the top surface of said horizontally positioned beam structure support member such that said horizontal flange member is consequently positioned in a plane in close proximity and parallel to the top surface of said beam structure support member, whereby a substantially horizontal platform is formed between a respective adjacent pair of said open-web joists, the top surface of said beam, and the edge of said corrugated decking, so that when concrete is poured over said top surface of said beam, said composite pan, said bearing ends, said shear stud(s), and said corrugated decking, said beam is composite with a resulting concrete slab.

2. The end connection means for a composite beam-joist system according to claim 1 wherein said horizontal flange segment is formed so as to extend in the same direction as said horizontal top surface segment in relation to said vertical panel segment, whereby a substantially U shaped channel profile for said composite pan results.

3. The end connection means for a composite beam-joist system according to claim 2 wherein said composite pan is secured in position by affixing said corrugated decking to said composite pan and said remaining opposed sections of said top chord top seat angles.

4. The end connection means for a composite beam-joist system according to claim 1 wherein said horizontal flange segment is formed so as to extend in an opposite direction as said horizontal top surface segment in relation to said vertical panel segment, whereby a substantially Z shaped channel profile for said composite pan results.

5. The end connection means for a composite beam-joist system according to claim 4 wherein said composite pan is secured in position by affixing said corrugated decking to said composite pan and said remaining opposed sections of said top chord top seat angles.

6. The end connection means for a composite beam-joist system according to claim 2 wherein said composite pan is formed to include a second vertical panel segment and a second horizontal flange segment, said second vertical panel segment disposed between, confluent with and substantially perpendicular to each of said horizontal top surface segment, at the end thereof opposite the location of the other vertical panel, and the second horizontal flange segment, said second horizontal flange segment orientated in the direction of the other horizontal flange segment, whereby the fabricated composite pan has a profile of a pair of opposed U shaped channels affixed along the length of said horizontal top surface segment.

7. The end connection means for a composite beam-joist system according to claim 6 wherein said composite pan is fabricated from a standard steel stud.

8. The end connection for composite beam-joist systems according to claim 1 wherein said composite pan is fabricated in a substantially rectangularly shaped metal sheet having a left side and a right side, said left and right sides having panels extending downward a spaced distance from a top surface of said metal sheet, said left side downwardly extending panel having a shelf portion at its base extending laterally opposite to said top surface of said metal sheet, said shelf portion having a centrally located tab stop means for automatically positioning said shelf portion a set point over said beam, said composite pan being inserted by an operator lengthwise between said top and bottom seat angles of a pair of said bearing end top chords, and pushed toward said beam until said shelf portion is positioned on a top surface of a beam flange, being positioned on said beam flange by said tab stop means.

9. The end connection for composite beam-joist systems according to claim 8 wherein said tab stop means is comprised of a centrally positioned cut-out in said shelf portion, said cut-out being comprised of a downwardly bent portion confluent with an obtuse angled forwardly bent portion cooperating to form a capture area for said beam flange.

10. The end connection for composite beam-joist systems according to claim 8 wherein said right side downwardly extending panel is slightly greater in length than said left side downwardly extending panel, and extends downward at an obtuse angle to said top surface of said metal sheet.

11. The end connection for composite beam-joist systems according to claim 10, further comprising an outwardly extending flange, said outwardly extending flange being substantially parallel to and extending in a direction away from said top surface of said metal sheet, affixed to a base portion of said right side downwardly extending panel for further stabilizing said composite pan between said opposed bearing ends.

12. A method for forming a concrete slab composite with a beam, comprising the steps of:

(a) placing at least two bearing ends of at least two open-web joists, including respective top chords having respective ends in near proximity to said beam, on a top surface of said beam, said bearing ends being substantially parallel to each other at a spaced distance apart on said top surface of said beam and located a spaced distance from a respective one of said ends of an associated top chord;

(b) placing corrugated decking on a top surface of said open-web joists;

(c) affixing at least one shear stud to said top surface of said beam adjacent said bearing ends;

(d) forming a horizontal platform between said bearing ends, said top surface of said beam, and an edge of said corrugated decking by positioning between opposed seat angles on said at least two bearing ends a composite pan, said composite pan configured to include a plurality of substantially rectangularly shaped segments including a horizontal top surface segment, a horizontal flange segment and a vertical panel segment disposed between, confluent with and substantially perpendicular to each of said horizontal top surface segment and horizontal flange segment, at least said vertical panel segment having no removal of material therefrom, that is, cut-out free, said horizontal top surface segment of said composite pan being positioned on and affixed to opposed top chord seat angles of adjacent open-web joists, said horizontal top surface of said composite pan extending from at least the edge of said corrugated decking to the respective first end of each of said pair of opposed angle iron members for each said open-web joist, such that said vertical panel is positioned at said respective first end of each of said pair of opposed angle iron members for each said open-web joist, said vertical panel extending downward a predetermined distance towards the top surface of said horizontally positioned beam structure support member such that said horizontal flange member is consequently positioned in a plane in close proximity and parallel to the top surface of said beam structure support member; and (e) pouring concrete over said horizontal platform, said bearing ends, said shear stud(s), and said top surface of said beam.

* * * * *